US005301598A

United States Patent [19]

Sonnabend

[11] Patent Number: 5,301,598

[45] Date of Patent: Apr. 12, 1994

[54] PISTON-CYLINDER UNIT FOR PRODUCING AND TRANSMITTING COMPRESSIVE FORCES

[75] Inventor: Karl H. Sonnabend, Ratingen, Fed. Rep. of Germany

[73] Assignee: SMS Schloemann-Siemag Aktiengesellschaft, Dusseldorf, Fed. Rep. of Germany

[21] Appl. No.: 802,129

[22] Filed: Dec. 3, 1991

[30] Foreign Application Priority Data

Dec. 6, 1990 [DE] Fed. Rep. of Germany ..... 4038950

[51] Int. Cl.[5] ..... F16J 1/10

[52] U.S. Cl. ..... 92/84; 92/129; 92/140; 92/113

[58] Field of Search ..... 92/84, 129, 140, 113, 92/114

[56] References Cited

U.S. PATENT DOCUMENTS

| | | | |
|---|---|---|---|
| 3,199,413 | 8/1965 | Margetts | 92/113 |
| 3,352,143 | 11/1967 | Bollar | 92/84 |
| 3,878,769 | 4/1975 | Farmer | 92/84 |

FOREIGN PATENT DOCUMENTS

| | | | |
|---|---|---|---|
| 970688 | 10/1958 | Fed. Rep. of Germany | 92/113 |
| 2650529 | 5/1978 | Fed. Rep. of Germany | 92/113 |
| 2818410 | 11/1979 | Fed. Rep. of Germany | 92/113 |

*Primary Examiner*—Thomas E. Denion

*Attorney, Agent, or Firm*—Anderson Kill Olick & Oshinsky

[57] ABSTRACT

A piston-cylinder unit for producing and transmitting compressive forces onto adjusting elements which are guided so as to be slidable on a straight line. The piston-cylinder unit includes a push rod mounted so as to be capable of oscillating transversely of the direction of the compressive forces in a unilaterally open skirt-type piston. The push rod is slidingly movable from a centered position into an oscillating position. The centered position is determined by sealing members placed so as to face each other and mounted at an outer periphery of the push rod and an inner rim of the skirt-type piston. The push rod is movable into the skirt-type piston toward a fixed stop arranged in the skirt-type piston. The push rod is movable against the force of a spring element arranged at the bottom of the skirt-type piston.

11 Claims, 5 Drawing Sheets

PISTON-CYLINDER UNIT FOR PRODUCING AND TRANSMITTING COMPRESSIVE FORCES

BACKGROUND OF THE INVENTION

1. Field of the Invention

The present invention relates to a piston-cylinder unit for producing and transmitting compressive forces onto adjusting elements which are guided so as to be slidable on a straight line. The piston-cylinder unit includes a push rod which is mounted so as to be capable of oscillating transversely of the direction of the compressive forces in a unilaterally open skirt-type piston.

2. Description of the Related Art

Piston-cylinder units of the above-described type are used, particularly in heavy machine construction, for applying a controllable pressure onto plane stop surfaces from adjusting elements which are slidable in sliding guides or for counteracting in an unloading manner the pressure acting on these elements. The push rods of the piston-cylinder units act on the respective contact surface of the adjusting element without being coupled to the latter. Piston-cylinder units of this type are arranged, for example, between the chocks of rolling mill stands with one or more pairs of rolls in order to support the chocks of a pair of rolls in a pressure-controlled manner relative to each other or to apply a pressure, for example, a bending pressure, onto the ends of the rolls for obtaining a partial deformation of the rolls.

The oscillating mounting of the push rod in the skirt-type piston of the piston-cylinder units of the above-described type takes into account the fact that the adjusting elements on which the push rod acts during practical operation frequently carry out more or less substantial movements transversely of the direction of the compressive forces which are due, for example, to unavoidable tolerances in the sliding guides of the adjusting elements. When this happens, the push rod absorbs the short transverse movements without changing the pressure contact between push rod and contact surface of the adjusting element with an oscillating movement in the skirt-type piston.

In a known piston-cylinder unit of the above-described type for the application of pressure from chocks of rolling mill rolls, the push rod rests with its crowned lower end surface on a spherical indentation arranged in the bottom portion of the skirt-type piston. The possible oscillating angle of the push rod is narrowly defined by the inner wall of the skirt-type piston in which the push rod is inserted with slight play and by an annular sealing member mounted on the rim of the skirt-type piston. This is to ensure that, after the transmission of the compressive forces onto the adjusting elements have concluded, the push rod again returns into the original centered position within the skirt-type piston and is not in an inclined position when a new force application movement begins.

It has been found that this type of configuration of the piston-cylinder unit is not suitable for absorbing greater oscillating movements of the adjusting elements as they occur. For example, due to worn sliding guides of the adjusting elements as a result of continuous operation, and that even if the oscillations are only slightly increased, the annular seals are subjected to pressures which exceed the elasticity limits of the sealing members and damage the sealing members as a result.

SUMMARY OF THE INVENTION

Therefore, it is the object of the present invention to improve the piston-cylinder units of the above-described type in such a way that substantially greater oscillations of the push rods are possible without resulting in damage to the sealing members and in which the push rod continues to be returned into its centered position after the transmission of compressive forces has concluded.

In accordance with the present invention, the push rod is slidingly movable into an oscillated position from a centered position determined by sealing members facing each other at the outer wall of the push rod and at the inner rim of the skirt-type piston, wherein the push rod is movable into the skirt-type piston toward a fixed stop arranged in the skirt-type piston against the force of a spring element arranged at the bottom of the skirt-type piston.

As a result of this configuration, it is possible to dimension the push rod in such a way that it is capable of carrying out significantly greater oscillating movements within the skirt-type piston. In addition, after the transmission of compressive forces onto the adjusting elements has concluded, the push rod is returned into the initial centered position by means of the spring elements.

In accordance with another feature of the invention, the sealing members may be conical surfaces provided at the inner wall of the skirt-type piston and on the outer circumference of the push rod, wherein the conical surfaces extend on the skirt-type piston on a conical ring which is slidable into and axially securable in the skirt-type piston and on the push rod in a neck-shaped annular incision.

The various features of novelty which characterize the invention are pointed out with particularity in the claims annexed to and forming a part of this disclosure. For a better understanding of the invention, its operating advantages attained by its use, reference should be had to the drawing and descriptive matter in which there are illustrated and described preferred embodiments of the invention.

DESCRIPTION OF THE PREFERRED EMBODIMENTS

Figure 1:
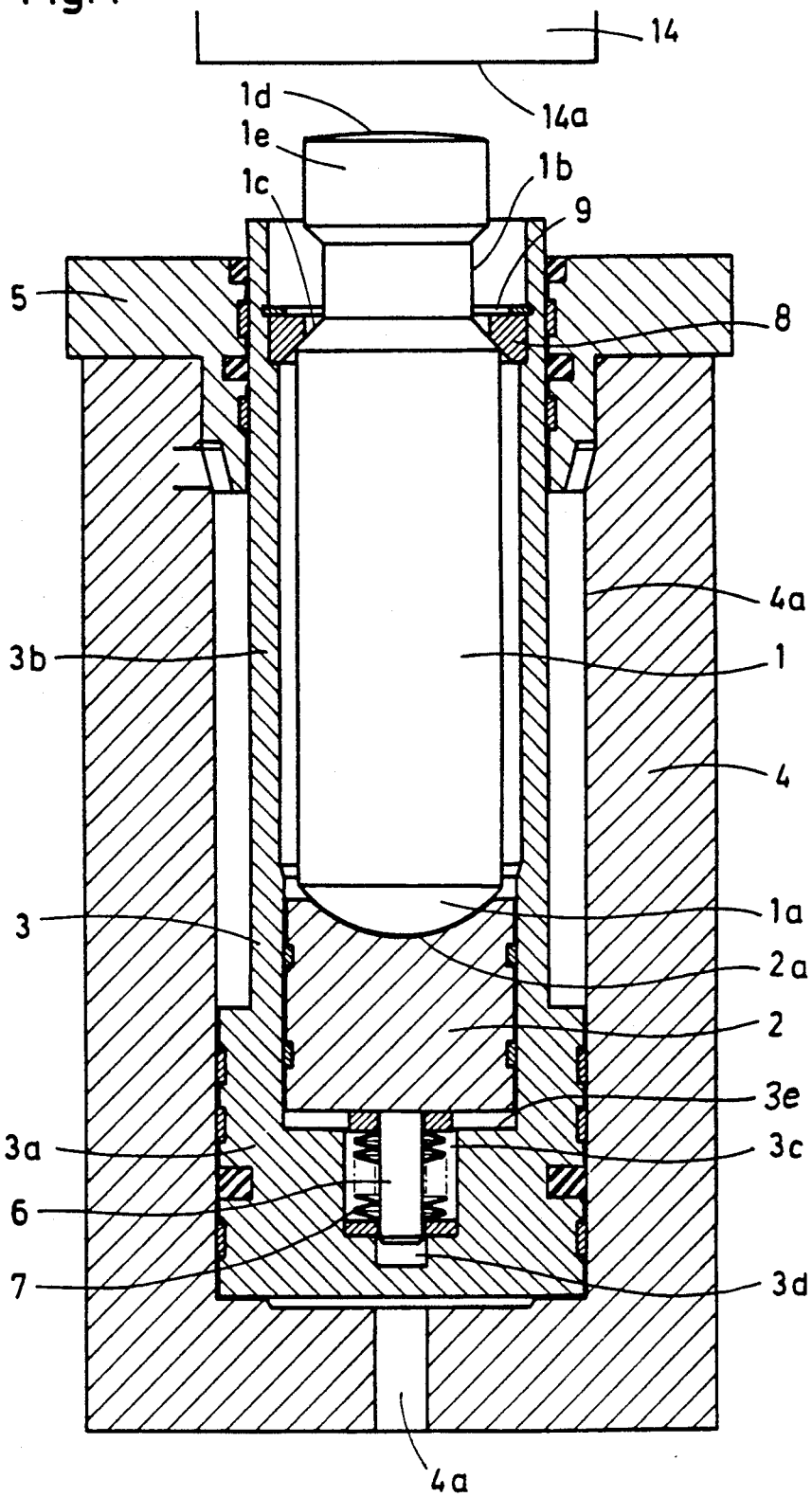
FIG. 1 to FIG. 4 are schematic sectional views of the piston-cylinder unit according to the present invention seen in axial direction, showing the piston-cylinder unit in different positions of operation.

As can be seen in FIG. 1 of the drawing, the push rod 1 rests with its crowned lower end surface 1*a* on a spherical indentation 2*a* which is part of a floating piston 2. This floating piston 2 is guided in a skirt-type piston 3 which is composed of a piston part 3*a* and a skirt portion 3*b*. The piston part 3*a* of the skirt-type piston 3 is guided in a cylinder 4 which is provided with a pressure medium supply opening 4*a* underneath the piston part 3*a* and is closed by a piston cover 5.

On the end face facing away from the spherical indentation 2*a*, the floating piston 2 has a guide pin 6 which is surrounded by a stack of springs 7 which is arranged in a bottom recess 3c of the piston part 3a. The only purpose of the guide pin 6 is to center the plate-type springs.

A cone ring 8 is placed in the skirt-type piston 3 in the upper part of the skirt portion 3b. The cone ring 8 is secured against axial displacement by means of a safety ring 9.

The push rod 1 has a neck-shaped annular portion lb with a conical surface 1c which, in the illustrated position of the push rod 1, rests on the conical surface of the cone ring 8. In this position, the push rod 1 is in its initial position relative to the adjusting element indicated by reference numeral 14 and its slightly curved end face 1d is located at a distance opposite the plane contact surface 14a of the adjusting element. As can be seen from the drawing, the push rod 1 is held in the centered position and is axially locked under the pressure of the stack of springs 7 by the conical surfaces of the cone ring 8.

Figure 2:
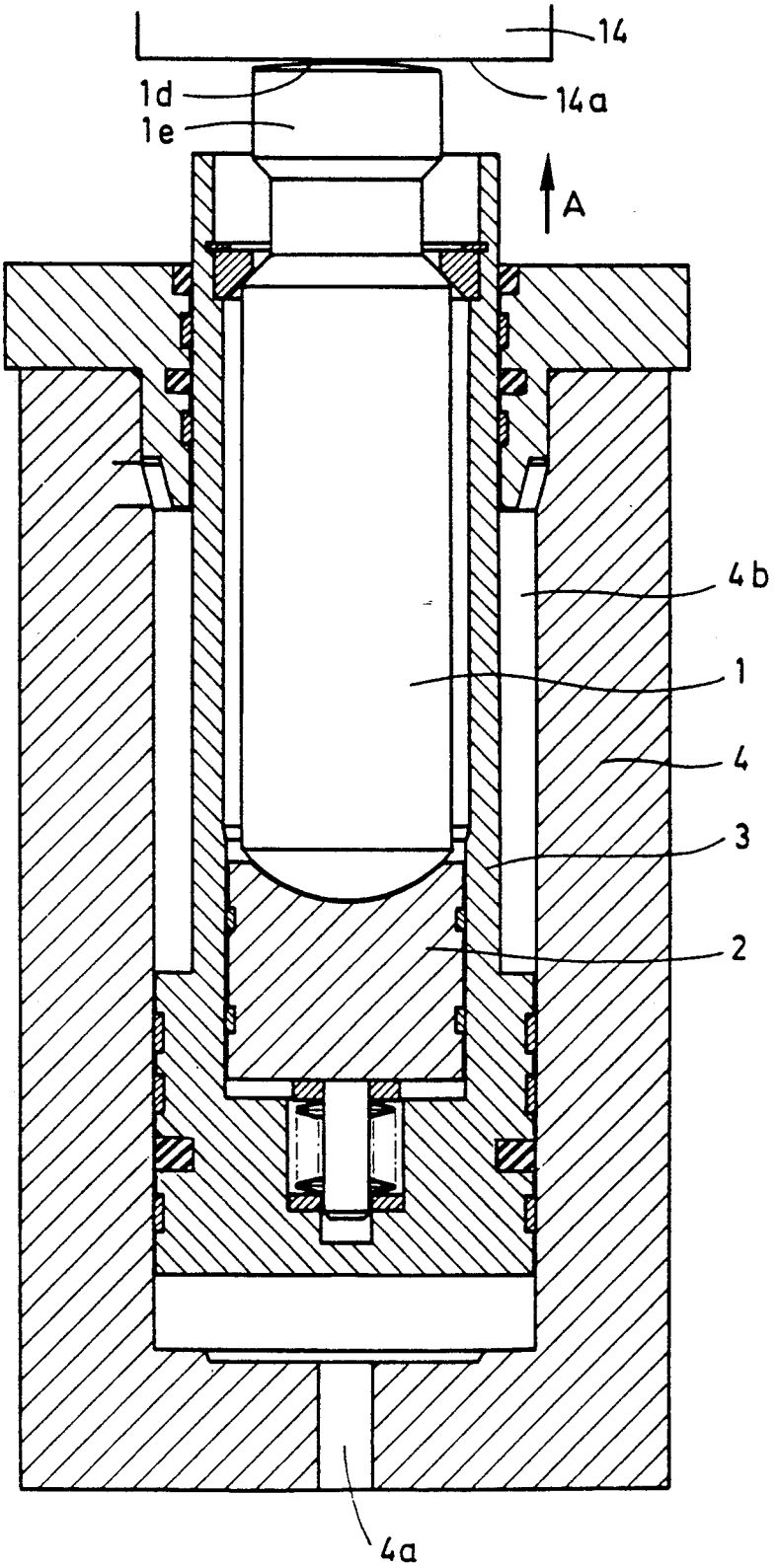

As illustrated in FIG. 2, when a pressure agent is introduced through the pressure agent supply opening 4a, the skirt-type piston 3 moves upwardly in the direction of the arrow A and takes along the push rod 1 wherein, however, the push rod 1 or the floating piston 2 does not change its relative position to the skirt-type piston 3.

Figure 3:
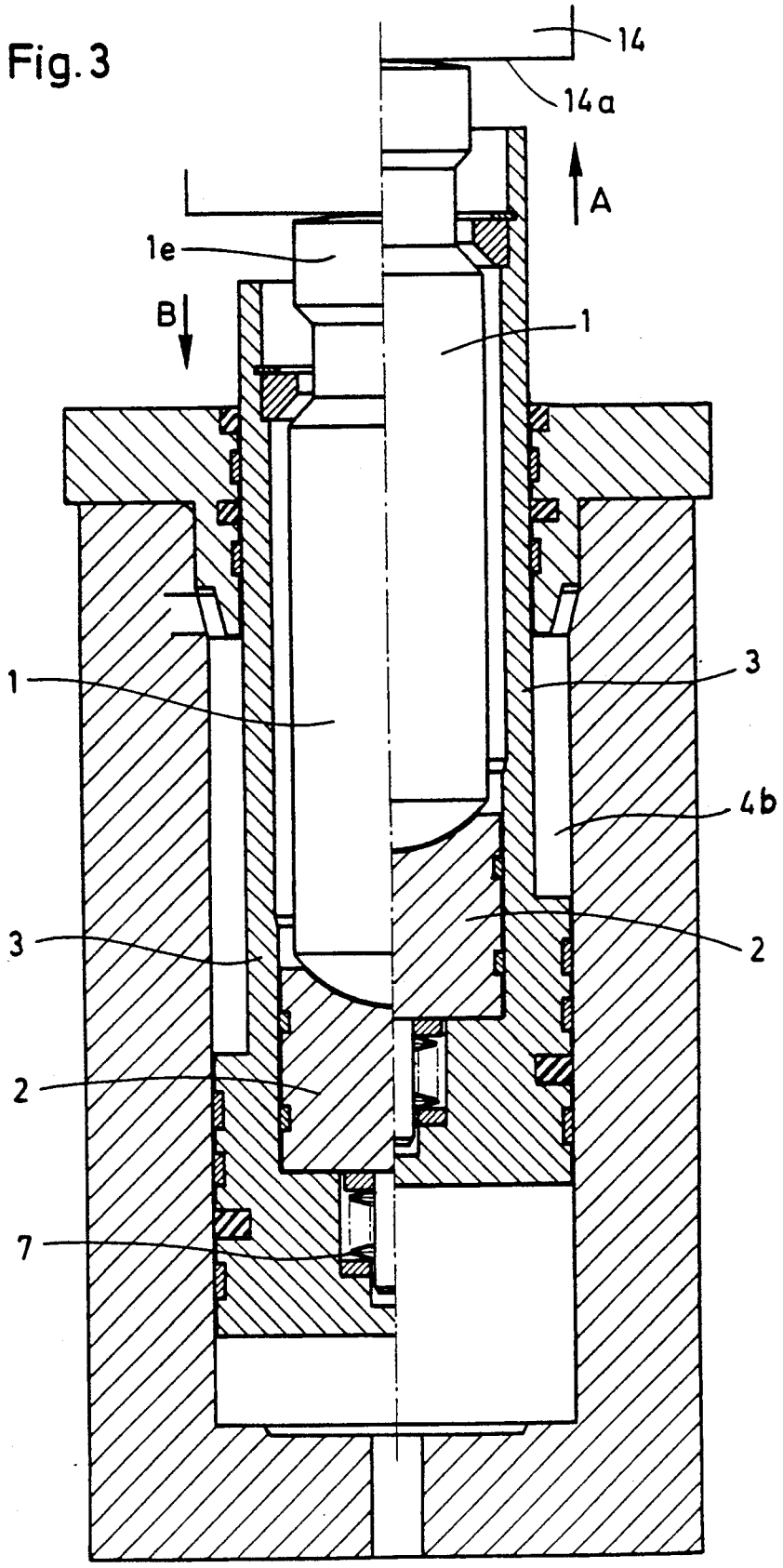

As can be seen in the left portion of FIG. 3, when the curved end face 1b of the push rod 1 makes contact with the stop surface 14a of the adjusting element 14, the push rod 1 is moved against the action of the stack of springs 7 in direction of arrow B together with the floating piston 2 into the skirt-type piston 3 until the floating piston 2 rests against the bottom 3e of the skirt-type piston 3 which serves, thus, as a stop for the downward movable push rod 1. As a result, the conical surface 1c of the neck-shaped annular portion 1d is separated from the conical surface of the cone ring 8 and, thus, the push rod 1 is no longer held in its centered position illustrated in FIG. 1. The push rod 1 can now be moved in this free position farther in the direction of arrow A against the stop surface 14a of the adjusting element 14, while the relative position thereof to the skirt-type piston 3 is no longer changed, as can be clearly seen in the right portion of FIG. 3.

Figure 4:
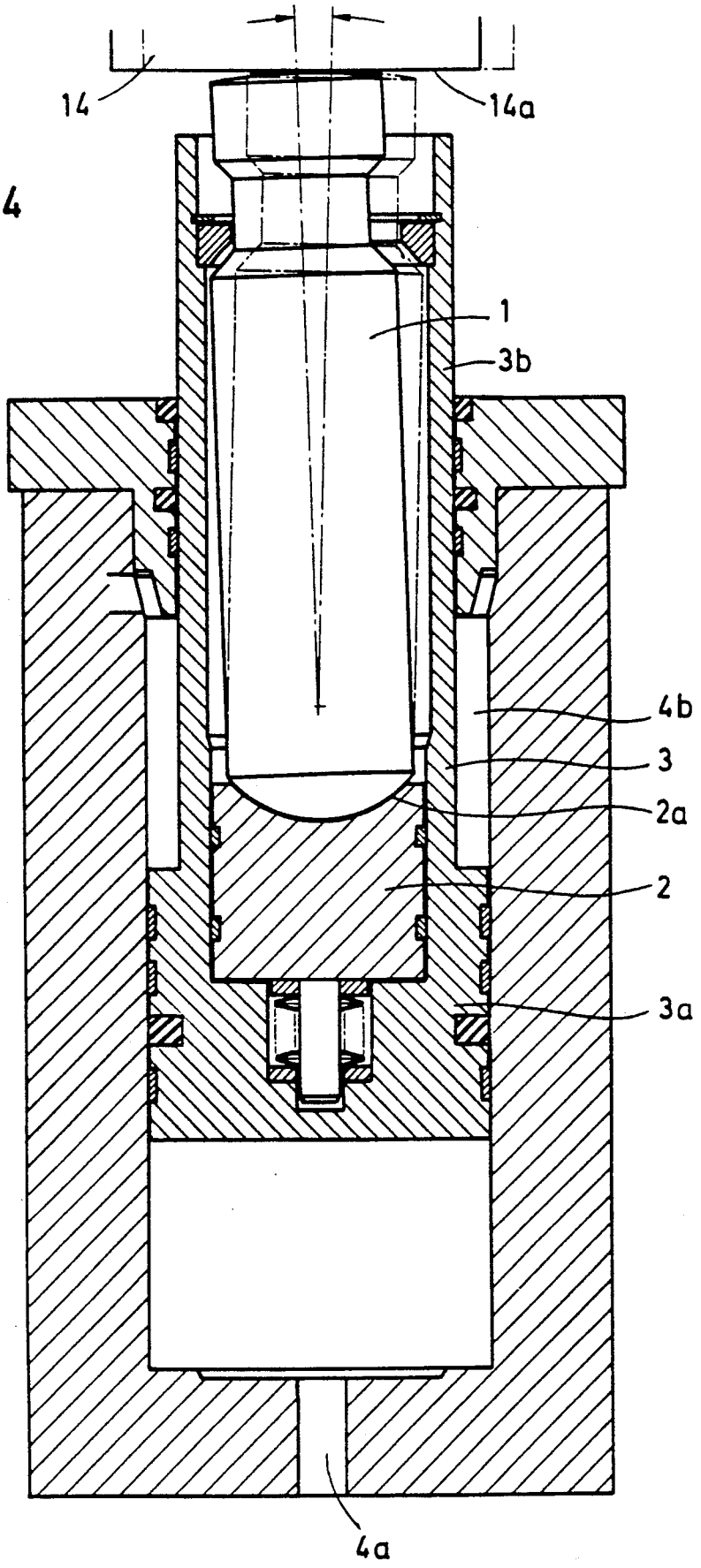

If transverse movements of the adjusting element 14 occur during the transmission of compressive forces to the adjusting element in both positions illustrated in FIG. 3, the push rod 1 can absorb such movements by oscillating in the spherical indentation 2a of the floating piston 2 freely movable within the skirt-type piston within the angle indicated in FIG. 4 by dash-dot lines. After the pressure transfer has been terminated by reversing the application of pressure medium of the piston part 3a through the annular cylinder space 4b in a manner which is not illustrated, the skirt-type piston 3 is moved opposite the direction of arrow A back into the position illustrated in FIG. 1, wherein the push rod 1 is again pushed by the action of the stack of springs 7 into the centered position determined by the conical surface 1c and the cone ring 8.

Figure 5:
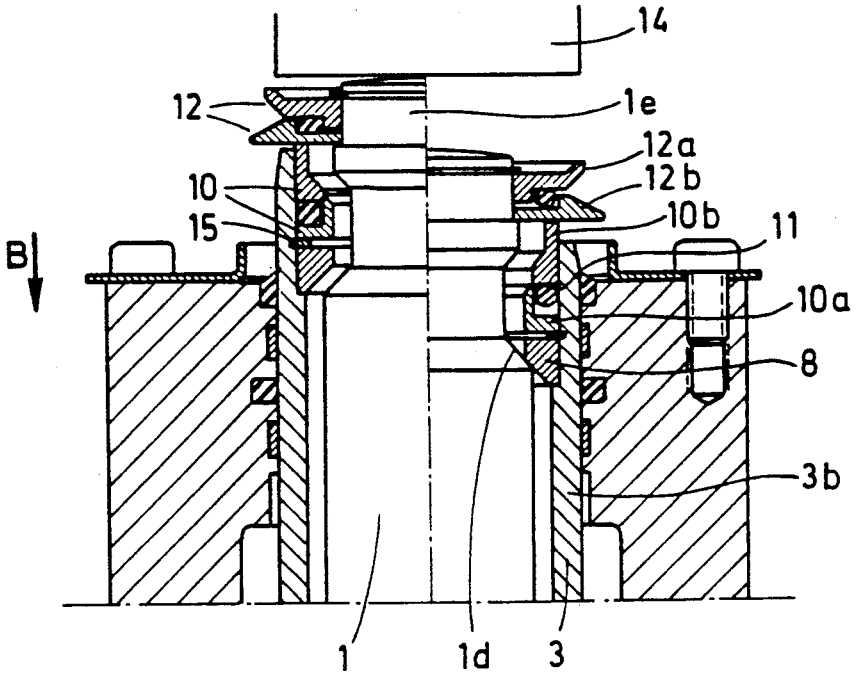
FIG. 5 is a schematic sectional view of another embodiment of the piston-cylinder unit according to the present invention.

In the embodiment of the piston-cylinder unit illustrated in FIG. 5, a two-part sealing ring sleeve 10 is arranged above the cone ring 8 in the open part of the skirt portion 3b of the skirt-type piston 3. This sealing ring sleeve 10 is composed of a lower grooved ring 10a which rests on the cone ring 8 or on a safety ring 15 placed over the cone ring 8, and of a sealing ring 10b guided in the groove of the groove ring 10a. An elastic intermediate ring 11 is placed in the groove between the two rings 10a and 10b. The head le of the push rod 1 is surrounded by a counter sealing ring 12 which also is composed of two rings 12a and 12b which are separated from each other by an elastic intermediate ring 13. As can be seen in FIG. 5, the diameter of this counter sealing ring 12 is significantly greater than that of the sealing ring 10b of the sealing ring 10.

In the initial position of the push rod 1 illustrated in the right portion of FIG. 5, in which the push rod 1 rests with the conical surface of the annular portion 1b against the cone ring 8, the lower ring 12b of the counter sealing ring 12 rests with a downwardly facing plane radial plate surface on the upper annular end face of the sealing ring 10b of the sealing ring 10 and, thus, covers in a sealing manner the upper opening of the skirt-type piston 3. As a result, the penetration of dirt into the skirt-type piston is prevented in any position of the push rod 1.

While specific embodiments of the invention have been shown and described in detail to illustrate the inventive principles, it will be understood that the invention may be embodied otherwise without departing from such principles.

I claim:

1. A piston cylinder unit for generating and transmitting compression forces to actuation elements displaceably guided in a straight line, comprising:

a skirt type piston open on one end;

a pressure tappet in said piston, abutted and sealed by ring elements against an internal wall of the skirt-type piston opening and protruding from the skirt-type piston opening with an end acting upon the actuation elements;

a floating piston with a hemispherical indentation on an upper portion thereof, wherein the pressure tappet is abutted with the hemispherical indentation and the pressure tappet is supported to execute a pendular motion inclined to a pressure direction;

wherein the floating piston is abutted by a spring on a lower portion thereof and is displaceably guided in the skirt-type piston;

cone-shaped surface in an internal wall of the skirt-type piston opening and on the external circumference on the pressure tappet, wherein said surfaces are brought by the pressure of the spring into an interacting position to each other to bring the pressure tappet into a centered position and to hold it there;

a guide pin protruding into a recess in the base of the skirt-type piston, wherein said guide pin is attached at an end face of the floating piston and enclosed by the spring; and sealing rings and sealing sleeves, at the end of the pressure tappet, acting upon the actuation element and in the skirt-type piston opening embracing the end thereof to be elastically displaceable or pressable against each other.

2. The piston-cylinder unit of claim 1, further comprising:

a cone shaped ring, wherein the cone-shaped ring is insertable into the shirt-type piston; and a neck-shaped annular incision, wherein the cone-shaped surface of the pressure tappet run in said incision.

3. The piston-cylinder unit of claim 1, wherein said sealing rings and sealing sleeve comprise respectively a pair of rings, further comprising elastic intermediate rings disposed in between said pair of rings.

4. The piston-cylinder of claim 1, wherein an application face of the sealing rings arranged at the end of the pressure tappet are configured as a planar dish and wherein the contact face of the sealing ring sleeves in the skirt-type piston are configured as an annular disk, wherein the diameter of the dish is dimensioned to be considerably larger than that of the annular disk.

5. The piston-cylinder of claim 3, wherein an application face of the sealing ring arranged at the end of the pressure tappet are configured as a planar dish and wherein the contact face of the sealing ring sleeves in the skirt-type piston are configured as an annular disk, wherein the diameter of the dish is dimensioned to be considerably larger than that of the annular disk.

6. A piston-cylinder unit for producing and transmitting compressive forces onto adjusting elements which are guided to be slidable along a straight line, comprising:

a unilaterally open skirt-type piston having a bottom and an inner rim;

a push rod mounted to be capable of oscillating transversely of the direction of the compressive forces in said open skirt-type piston, wherein the push rod has an outer periphery and is mounted to be slidingly movable from a centered position into an oscillated position;

a sealing means mounted at the outer periphery of the push rod and at the inner rim of the skirt-type piston, wherein the centered position is determined by the sealing means;

a spring element arranged at the bottom of the skirt-type piston;

a fixed stop arranged in the skirt-type piston, wherein the push rod is movable into the skirt-type piston toward the fixed stop against a force of the spring element;

a head on the push rod;

a sealing ring mounted to surrounded the head of the push rod;

a sealing ring sleeve mounted on the inner rim of the skirt-type piston, wherein the sealing ring and the sealing ring sleeve are elastically movable against each other;

wherein the sealing ring and the sealing ring sleeve mounted on the inner rim, further comprises:

a pair of rings; and elastic intermediate rings arranged between the rings.

7. The piston-cylinder unit of claim 6, wherein the push rod has a crowned lower support surface, wherein said unit further comprises:

a piston member floatingly guided in the skirt-type piston, wherein said piston member has a spherical indentation facing a support surface of the push rod and an end face facing the bottom of the skirt-type piston;

a recess at the bottom of the skirt-type piston;

wherein said spring element comprises a stack of springs, and wherein the stack is mounted in the recess of the bottom of the shirt-type piston and biases the end face of the piston member.

8. The piston-cylinder unit of claim 7, further comprising a guide pin attached to the end face of the piston member and extending into the recess in the bottom of the skirt-type piston, wherein said stack of springs surrounds the guide pin.

9. The piston-cylinder unit of claim 6, further comprising:

a contact surface on the sealing ring mounted on the head of the push rod, and wherein the contact surface is a plane plate-shaped surface; and a contact surface in the form of an annular disk in the sealing ring sleeve arranged in the skirt-type piston, wherein the annular disk has a diameter, wherein the plate-shaped surface has a diameter which is substantially greater than the diameter of the annular disk.

10. A piston-cylinder unit for producing and transmitting compressive forces onto adjusting elements which are guided to be slidable along a straight line, comprising:

a unilaterally open skirt-type piston having a bottom and an inner rim;

a push rod mounted for oscillating transversely of the direction of the compression forces in said open skirt-type piston, wherein the push rod has an outer periphery and is mounted to be slidingly movable from a centered position into an oscillated position;

a sealing means mounted at the outer periphery of the push rod and at the inner rim of the skirt-type piston, wherein the centered position is determined by the sealing means;

a spring element arranged at the bottom of the skirt-type piston;

a fixed stop arranged in the skirt-type piston, wherein the push rod is movable into the skirt-type piston toward the fixed stop against a force of the spring element;

a heat on the push rod;

a sealing ring mounted top surround the head of the push rod;

a sealing ring sleeve mounted on the inner rim of the skirt-type piston, wherein the sealing ring and the sealing ring sleeve are elastically movable against each other;

a pair of rings on the sealing ring and ring sleeves; and elastic intermediate rings arranged between the pairs of rings.

11. A piston-cylinder unit for producing and transmitting compressive forces onto adjusting elements which are guided to be slidable along a straight line, comprising:

a unilaterally open skirt-type piston having a bottom and an inner rim;

a push rod mounted for oscillating transversely of the direction of the compressive forces in said open skirt-type piston, wherein the push rod has an outer periphery and is mounted to be slidingly movable from a centered position into an oscillated position;

a sealing means mounted at the outer periphery of the push rod and at the inner rim of the skirt-type piston, wherein the centered position is determined by the sealing means;

a spring element arranged at the bottom of the skirt-type piston;

a fixed stop arranged in the skirt-type piston, wherein the push rod is movable into the skirt-type piston toward the fixed stop against a force of the spring element at the bottom of the skirt-type piston;

a head on the push rod;

a sealing ring mounted to surround the head of the push rod;

a sealing ring sleeve mounted on the inner rim of the skirt-type piston, wherein the sealing ring and the sealing ring sleeve are elastically movable against each other;

a pair of rings on the sealing ring and ring sleeve;

elastic intermediate rings arranged between the pairs of rings;

a contact surface on the sealing ring, wherein the sealing ring is mounted on the head of the push rod, wherein the contact surface is a plane plate-shaped surface; and a contact surface in the form of an annular disk in the sealing ring sleeve arranged in the skirt-type piston, wherein the annular disk has a diameter, wherein the plate-shaped surface has a diameter which is substantially greater than the diameter of the annular disk.

* * * * *